US008710947B2

(12) United States Patent
Wada et al.

(10) Patent No.: US 8,710,947 B2
(45) Date of Patent: Apr. 29, 2014

(54) INDUCTANCE ELEMENT

(75) Inventors: Tomoyuki Wada, Kyoto-fu (JP); Masahiro Bando, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 13/550,027

(22) Filed: Jul. 16, 2012

(65) Prior Publication Data

US 2013/0027166 A1 Jan. 31, 2013

(30) Foreign Application Priority Data

Jul. 29, 2011 (JP) ..... 2011-166897

(51) Int. Cl.
*H01F 27/29* (2006.01)
*H01F 27/02* (2006.01)
*H01F 27/24* (2006.01)

(52) U.S. Cl.
USPC ..... 336/192; 336/83; 336/221

(58) Field of Classification Search
USPC ..... 336/192, 200, 221, 83
See application file for complete search history.

(56) References Cited

U.S. PATENT DOCUMENTS

| | | | | |
|---|---|---|---|---|
| 4,777,461 | A * | 10/1988 | Sakamoto | 333/184 |
| 5,680,087 | A * | 10/1997 | Sakata et al. | 336/83 |
| 5,719,547 | A * | 2/1998 | Kaneko et al. | 336/180 |
| 7,078,988 | B2 * | 7/2006 | Suzuki et al. | 333/181 |
| 7,477,122 | B2 * | 1/2009 | Iguchi et al. | 336/192 |
| 2007/0188281 | A1 | 8/2007 | Iguchi et al. | |
| 2007/0193022 | A1 * | 8/2007 | Kuroiwa et al. | 29/602.1 |

FOREIGN PATENT DOCUMENTS

| | | | |
|---|---|---|---|
| JP | 02-027530 | A | 1/1990 |
| JP | 07-302719 | A | 11/1995 |
| JP | 2007-214521 | A | 8/2007 |
| JP | 2010-109211 | A | 5/2010 |
| JP | 2010-171054 | A | 8/2010 |
| JP | 2011-138911 | A | 7/2011 |
| KR | 10-2007-0080831 | A | 8/2007 |

OTHER PUBLICATIONS

An Office Action; "Notice of Preliminary Rejection," issued by the Korean Intellectual Property Office on Sep. 17, 2013, which corresponds to Korean Patent Application No. 10-2012-82371 and is related to U.S. Appl. No. 13/550,027.

An Office Letter; "Preliminary Examination Report," issued by the Taiwan Intellectual Property Office on Jan. 24, 2014, which corresponds to Taiwanese Patent Application No. 101124899 and is related to U.S. Appl. No. 13/550,027.

* cited by examiner

*Primary Examiner* — Alexander Talpalatski
*Assistant Examiner* — Mangtin Lian
(74) *Attorney, Agent, or Firm* — Studebaker & Brackett PC

(57) ABSTRACT

This disclosure provides an inductance element including a core, a conductive wire, and a pair of terminal electrodes. The core includes an upper flange portion and a lower flange portion formed on both ends of a winding-core portion, and the conductive wire is wound around the winding-core portion. End portions of the wire connect to a pair of terminal electrodes formed on a bottom surface of the lower flange portion. Each terminal electrode includes a principal electrode region and a pair of extension electrode regions extending from the principal electrode region toward respective side surfaces of the lower flange portion. Each extension electrode region of each terminal electrode is not formed on a region of the bottom surface of the lower flange portion through which one of the end portions of the conductive wires pass.

7 Claims, 18 Drawing Sheets

INDUCTANCE ELEMENT

CROSS REFERENCE TO RELATED APPLICATIONS

The present application claims priority from Japanese Patent Application No. 2011-166897 filed on Jul. 29, 2011, the entire contents of which are hereby incorporated by reference into this application.

TECHNICAL FIELD

The technical field relates to an inductance element, and more specifically relates to an inductance element that can be mounted on any of land electrodes having a plurality of widths.

BACKGROUND

As an inductance element used in various electronic devices, an inductance element is widely known which has a structure in which a conductive wire is wound around a drum-shaped core and both ends of the conductive wire are connected to terminal electrodes formed on the core.

For example, Japanese Unexamined Patent Application Publication No. 2010-171054 discloses an existing inductance element having such a structure. FIG. 9 shows an inductance element 800 disclosed in Japanese Unexamined Patent Application Publication No. 2010-171054.

The inductance element 800 includes a drum-shaped core 101. The core 101 has a structure in which an upper flange portion 102 and a lower flange portion 103 are formed on both ends of a winding-core portion (not shown). In FIG. 9, for convenience of explanation, the inductance element 800 is turned upside down, namely, is shown such that the upper flange portion 102 is located on the lower side and the lower flange portion 103 is located on the upper side.

The lower flange portion 103 has an inner surface (not shown) on the winding-core portion side, a bottom surface 103*a*, a pair of side surfaces 103*b*, and a pair of end surfaces 103*c*. Each side surface 103*b* is formed in a shape in which a plurality of surfaces are connected in series.

In addition, a conductive wire 104 is wound around the winding-core portion of the core 101 and covered with an insulating coating.

Further, a pair of terminal electrodes 105 is formed on the bottom surface 103*a* of the lower flange portion 103 of the core 101. The insulating coating is removed from both end portions 104*a* of the conductive wire 104, and both end portions 104*a* are connected to the respective terminal electrodes 105, through the side surface 103*b* and the bottom surface 103*a* of the lower flange portion 103.

In the inductance element 800, a pair of grooves 103*d* is formed in the bottom surface 103*a* of the lower flange portion 103, and both end portions 104*a* of the conductive wire 104 are accommodated in the grooves 103*d*. In addition, the terminal electrodes 105 are formed by burying solder in recesses (not shown) provided in the bottom surface 103*a* of the lower flange portion 103. However, the grooves 103*b* are not necessarily needed. In addition, the terminal electrodes 105 are generally formed by burning a silver paste onto the bottom surface 103*a* of the lower flange portion 103, rather than by burying the solder in the recesses.

However, when being mounted by means of reflow soldering using cream solder or the like, the existing inductance element 800 described above can appropriately be mounted on a land electrode having a specific width, but cannot appropriately be mounted on a land electrode having a width other than the specific width.

In other words, besides the inductor element, for an electronic component, a recommended land electrode dimension is often specified by its manufacturer or distributor (hereinafter, referred to "manufacturer etc."). For example, an A company, which is a manufacturer etc., recommends a pair of land electrodes (hereinafter, referred to as "narrow land electrodes 201") each having a width of about 1.0 mm and a length of about 0.9 mm and arranged so as to face each other at an interval of about 0.8 mm as shown in FIG. 10A, and manufactures and sells inductance elements including terminal electrodes corresponding to these land electrodes. Meanwhile, a B company, which is another manufacturer etc., recommends a pair of land electrodes (hereinafter, referred to as "wide land electrodes 202") each having a width of about 1.6 mm and a length of about 0.65 mm and arranged so as to face each other at an interval of about 0.7 mm as shown in FIG. 10B, and manufactures and sells inductance elements including terminal electrodes corresponding to these land electrodes.

It is noted that mounting of an inductance element is conducted by applying cream solder or the like to the surfaces of the narrow land electrodes 201 or wide land electrodes 202 formed on a substrate, disposing the inductance element thereon, putting the substrate into a tunnel furnace or the like, heating the substrate in the tunnel furnace or the like, taking out the substrate from the tunnel furnace or the like, and cooling the substrate.

Since each terminal electrode 105 is formed so as to have a width of about 1.0 mm, the inductance element 800 can appropriately be mounted on the narrow land electrodes 201 as shown in FIG. 11A (In FIG. 11A, portions of the narrow land electrodes 201 which are hidden by the inductance element 800 are shown by dotted lines, and the terminal electrodes 105, which cannot be seen since the terminal electrodes 105 are formed on the bottom surface of the inductance element 800, are shown by dotted lines with hatching. The same applies to FIGS. 11B, 13A, and 13B.).

However, when the inductance element 800 is mounted on the wide land electrodes 202, the inductance element 800 may rotate on the wide land electrodes 202 as shown in FIG. 11B. This is because when heating is conducted and cream solder is melted, the position of the inductance element 800 is not stabilized and the inductance element 800 moves.

In order to appropriately mount the inductance element on the wide land electrodes 202, the terminal electrodes have to be formed so as to have large widths. FIG. 12 shows another existing inductance element 900 in which the widths of the terminal electrodes 105 of the inductance element 800 are increased.

In the inductance element 900, each terminal electrode 115 is formed so as to have a width of about 1.6 mm. The other configuration of the inductance element 900 is the same as that of the inductance element 800 described above.

As a result, the inductance element 900 can appropriately be mounted on the wide land electrodes 202 as shown in FIG. 13A.

However, when the inductance element 900 is mounted on the narrow land electrodes 201, the inductance element 900 may shift to one side of the narrow land electrodes 201 as shown in FIG. 13B. This is because when heating is conducted and cream solder is melted, the position of the inductance element 900 is not stabilized and the inductance element 900 moves.

As described above, when the existing inductance element 800 or 900 is mounted by means of reflow soldering using cream solder or the like, the inductance element can appropriately be mounted on land electrodes each having a specific width, but cannot appropriately be mounted on land electrodes each having a width other than the specific width. In other words, if the dimensions of the land electrodes recommended by the A company and the B company are different from each other, only the inductance element of the A company can be mounted on the land electrodes recommended by the A company, only the inductance element of the B company can be mounted on the land electrodes recommended by the B company, and each inductance element is not compatible with the land electrodes of the other company.

It is noted that in the existing inductance element 900 in which each terminal electrode 115 has an increased width, it is difficult to find breakage of the conductive wire 104. In other words, each end portion 104*a* of the conductive wire 104 is connected to the terminal electrode 115 formed on the bottom surface 103*a* of the lower flange portion 103, through the side surface 103*b* of the lower flange portion 103, and the conductive wire 104 is likely to be broken near the side formed by the side surface 103*b* and the bottom surface 103*a* of the lower flange portion 103. However, when each terminal electrode 115 having an increased width is present on the bottom surface 103*a* of the lower flange portion 103 and near the side formed by the side surface 103*b* and the bottom surface 103*a*, breakage of the conductive wire 104 in this portion is easily overlooked during inspection with naked eyes. In other words, the conductive wire 104, from which the insulating coating is removed, and each terminal electrode 115 have metal colors, and thus it may be erroneously determined that the conductive wire 104 is not broken, even if the conductive wire 104 is broken.

SUMMARY

According to an aspect of the present disclosure, an inductance element includes a core including a winding-core portion and an upper flange portion and a lower flange portion which are formed on both ends of the winding-core portion. A conductive wire is wound around the winding-core portion. A pair of terminal electrodes is formed on the lower flange portion. The lower flange portion has an inner surface, a bottom surface, a pair of side surfaces, and a pair of end surfaces. The pair of terminal electrodes each includes a principal electrode region formed on the bottom surface of the lower flange portion and at least a pair of extension electrode regions. Each of the pair of extension electrode regions extends from the principal electrode region toward a respective one of the side surfaces of the lower flange portion. End portions of the conductive wire are each connected to one of the terminal electrodes through one of the side surfaces and the bottom surface of the lower flange portion. The extension electrode regions of each terminal electrode are not formed on a region of the bottom surface of the lower flange portion through which one of the end portions of the conductive wire pass.

In a more specific embodiment, a recess portion through which the conductive wire passes may be formed in the side surface of the lower flange portion.

In another more specific embodiment, the terminal electrodes may each further include an end surface electrode region formed on the corresponding end surface of the lower flange portion.

In yet another more specific embodiment, each extension electrode region of each terminal electrode may have a step-like portion formed therein and has a plurality of different lengths from the principal electrode region toward the corresponding side surface of the lower flange portion.

In another more specific embodiment, each extension electrode region of each terminal electrode may extend to the respective one of the side surfaces of the lower flange portion.

Other features, elements, and characteristics, and advantages will become more apparent from the following detailed description of exemplary embodiments with reference to the attached drawings.

DESCRIPTION OF THE PREFERRED EMBODIMENTS

Hereinafter, embodiments for practicing the present invention will be described with reference to the drawings.

Figure 1A:
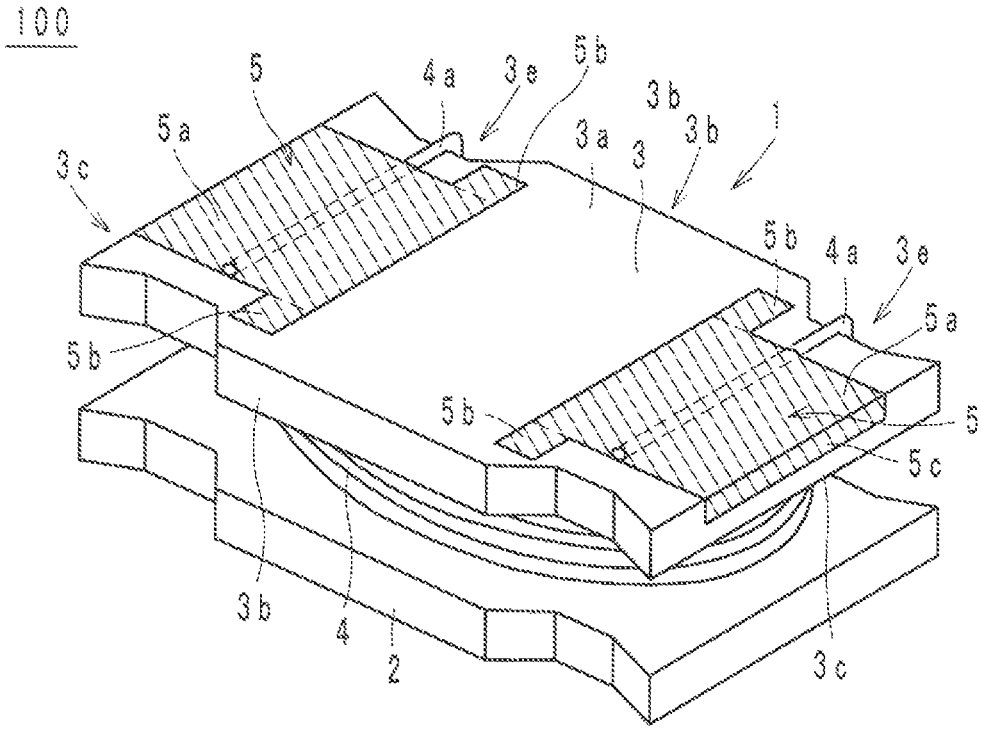
FIG. 1A is a perspective view showing an inductance element according to a first exemplary embodiment.
Figure 1B:
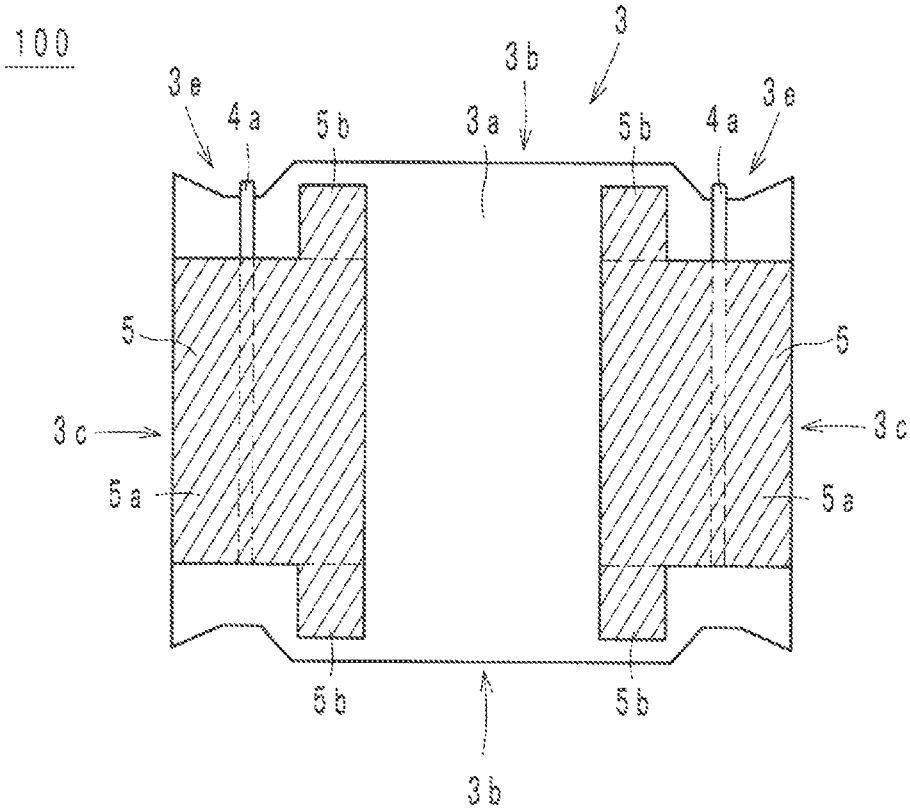
FIG. 1B is a bottom view showing the inductance element of FIG. 1A.

FIGS. 1A and 1B show an inductance element 100 according to a first exemplary embodiment. FIG. 1A is a perspective view, and FIG. 1B is a bottom view.

The inductance element 100 includes a drum-shaped core 1 formed from ferrite or the like. The core 1 has a structure in which an upper flange portion 2 and a lower flange portion 3 are formed on both ends of a winding-core portion (not shown). In FIG. 1A, for convenience of explanation, the inductance element 100 is turned upside down, namely, is shown such that the upper flange portion 2 is located on the lower side and the lower flange portion 3 is located on the upper side. The core 1 may be formed from a magnetic material such as ferrite or may be formed from a nonmagnetic material such as alumina.

The lower flange portion 3 has an inner surface (not shown) on the winding-core portion side, a bottom surface 3*a* on the back side to the inner surface, a pair of side surfaces 3*b*, and a pair of end surfaces 3*c*. Each side surface 3*b* is formed in a shape in which a plurality of surfaces are connected in series, and a recess portion 3*e* for passing a conductive wire 4 therethrough is formed by these surfaces.

In addition, the conductive wire 4 is wound around the winding-core portion of the core 1, is covered with an insulating coating such as polyurethane, and is formed from Cu, Ag, or the like.

Further, a pair of terminal electrodes 5 is formed on the bottom surface 3*a* of the lower flange portion 3 of the core 1. The terminal electrodes 5 are formed, for example, by burning a silver paste, a copper paste, or the like.

Each terminal electrode 5 has, in the bottom surface 3*a* of the lower flange portion 3, a principal electrode region 5*a* and at least a pair of extension electrode regions 5*b* extending from the principal electrode region 5*a* toward the respective side surfaces 3*b* of the lower flange portion 3. Further, each terminal electrode 5 has an end surface electrode region 5*c* on the corresponding end surface 3*c* of the lower flange portion 3. In FIG. 1B, a dotted line is shown between each principal electrode region 5*a* and each extension electrode region 5*b* for the sake of explanation, and both regions are actually formed integral with each other.

Figure 10A:
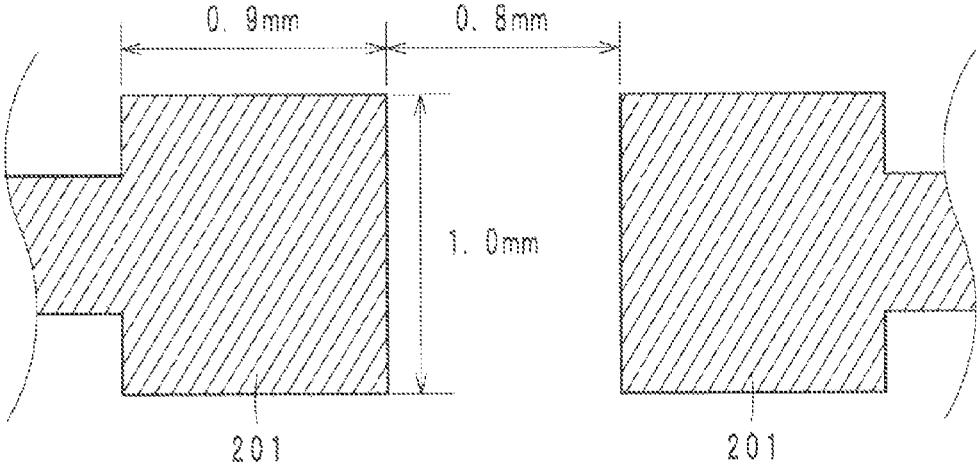
FIG. 10A Prior Art
FIG. 10A is a plan view showing narrow land electrodes.
Figure 10B:
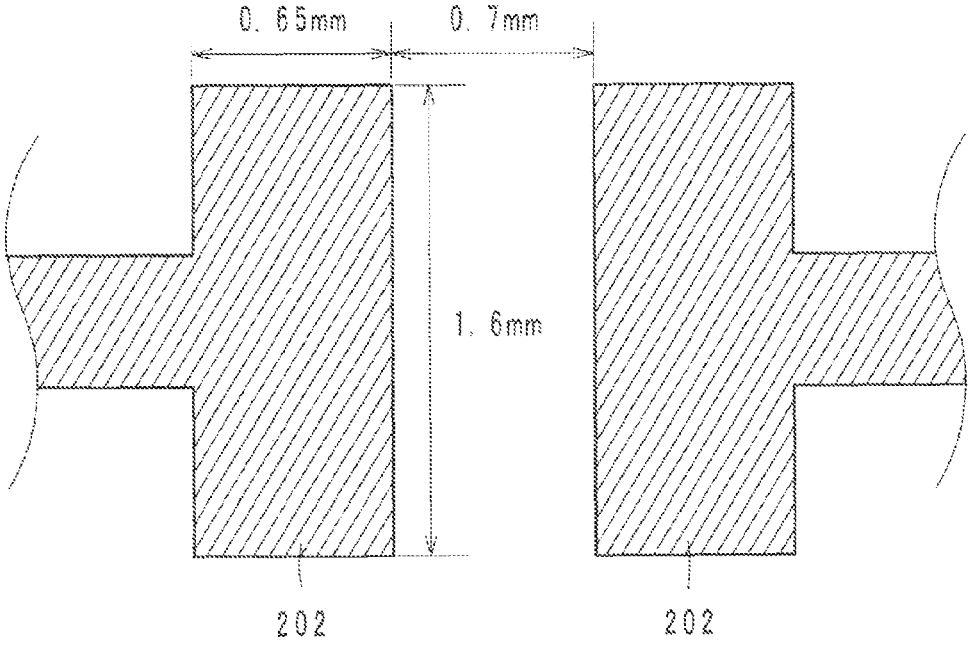
FIG. 10B Prior Art
FIG. 10B is a plan view showing wide land electrodes.
Figure 11A:
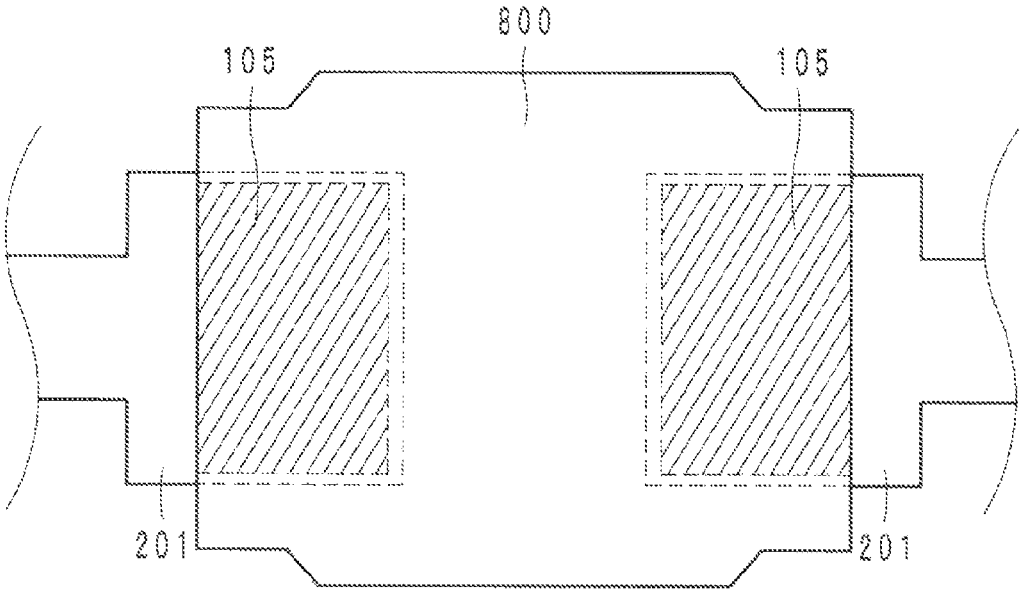
FIG. 11A Prior Art
FIG. 11A is a plan view showing a state where the inductance element of FIG. 9 is mounted on the narrow land electrodes.
Figure 11B:
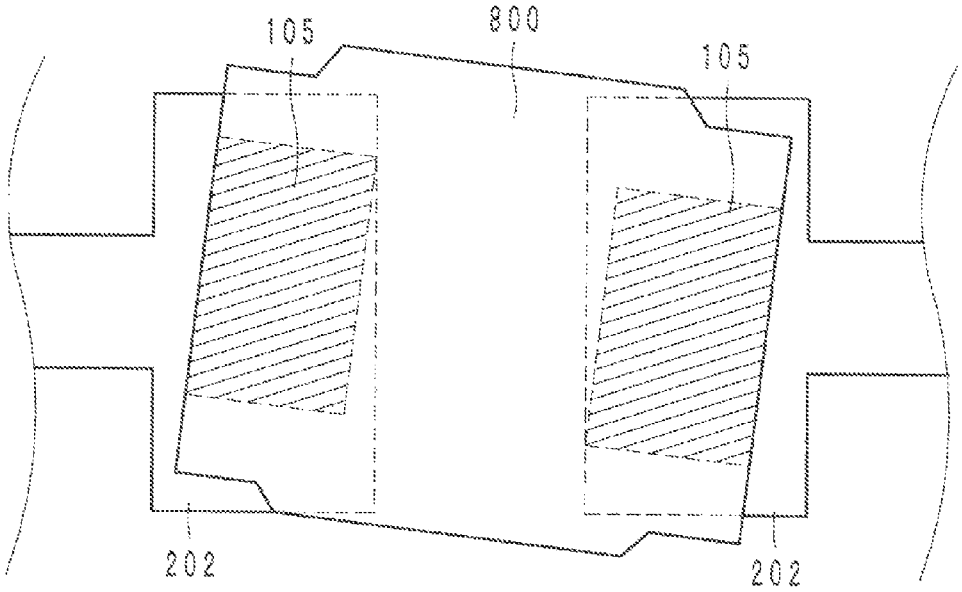
FIG. 11B Prior Art
FIG. 11B is a plan view showing a state where the inductance element of FIG. 9 is mounted on the wide land electrodes.
Figure 12:
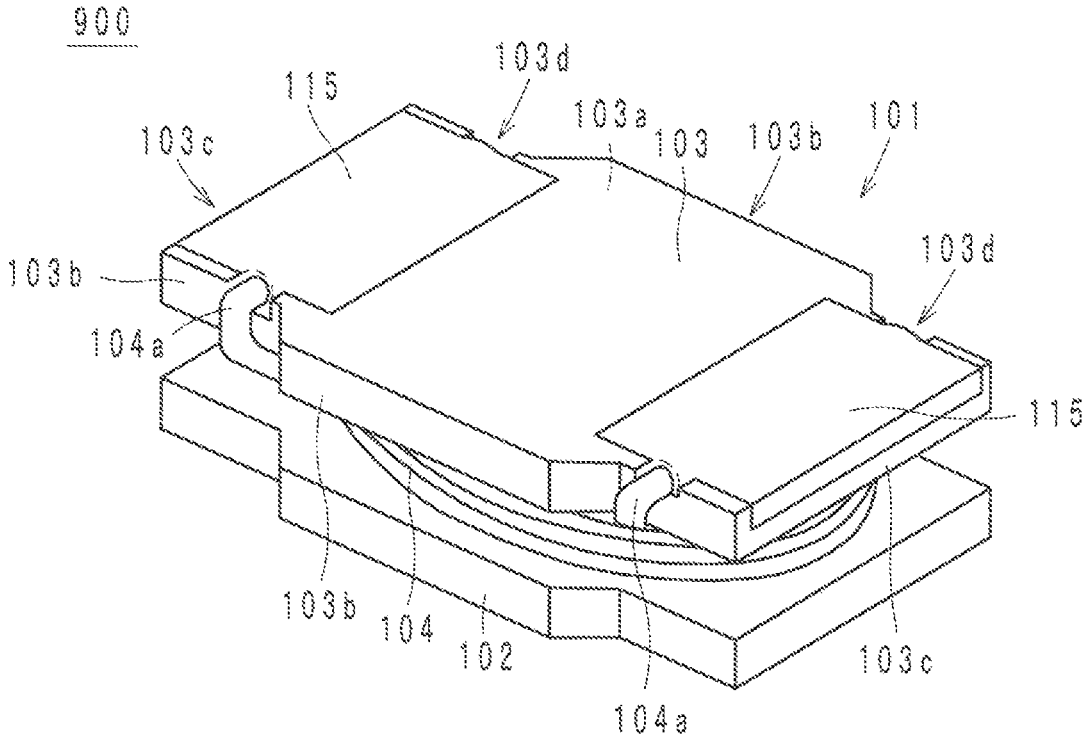
FIG. 12 Prior Art
FIG. 12 is a perspective view showing another existing inductance element.
Figure 13A:
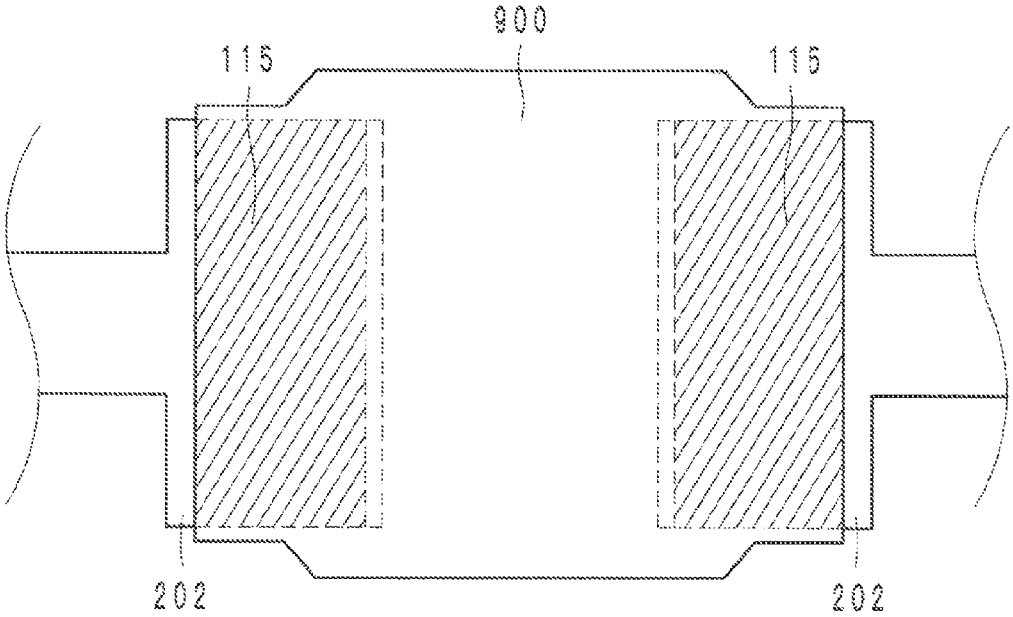
FIG. 13A Prior Art
FIG. 13A is a plan view showing a state where the inductance element of FIG. 12 is mounted on the wide land electrodes.
Figure 13B:
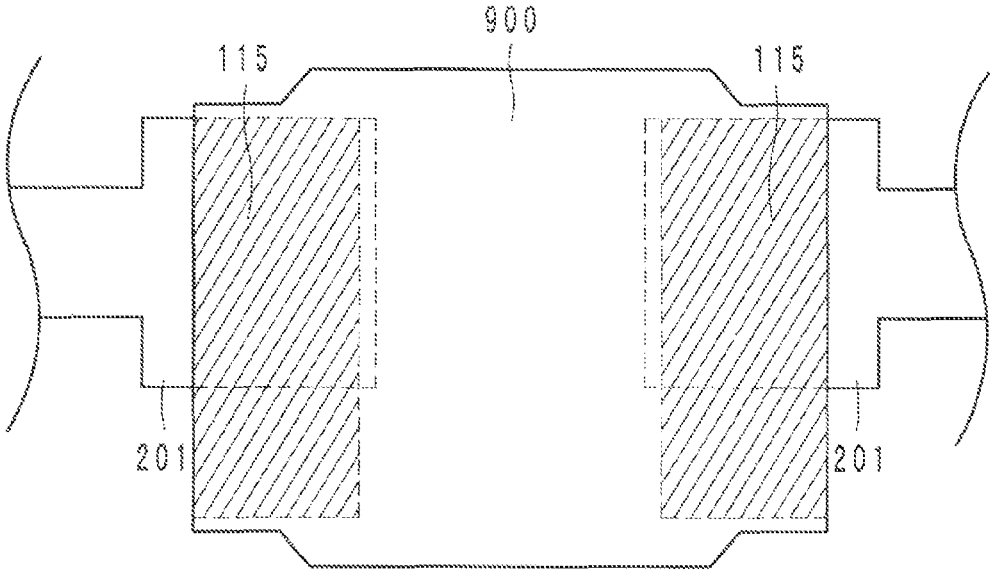
FIG. 13B Prior Art
FIG. 13B is a plan view showing a state where the inductance element of FIG. 12 is mounted on the narrow land electrodes.

Each principal electrode region 5*a* serves to enable mounting on the narrow land electrode 201 shown in FIG. 10A, and has a width of about 1.0 mm. Meanwhile, each extension electrode region 5*b* serves to enable mounting on the wide land electrode 202 shown in FIG. 10B, and the width from an end of one extension electrode region 5*b* to an end of the other extension electrode region 5*b* is about 1.6 mm. Each end surface electrode region 5*c* allows a solder fillet to be formed between this region and a land electrode to strengthen joining, and also serves to appropriately adjust the mounting position.

The insulating coating is in advance removed from both end portions 4*a* of the conductive wire 4, and both end portions 4*a* are then connected to the respective terminal electrodes 5 through the respective side surface 3*b* and the bottom surface 3*a* of the lower flange portion 3.

Near the connection portion between each end portion 4*a* of the conductive wire 4 and each terminal electrode 5 in the bottom surface 3*a* of the lower flange portion 3, the extension electrode regions 5*b* of the terminal electrode 5 are not formed and the bottom surface 3*a* of the lower flange portion 3 is exposed. Thus, even when the conductive wire 4 is broken near the side formed by the side surface 3*b* and the bottom surface 3*a* of the lower flange portion 3, the breakage can easily be found. Therefore, a defective product is not erroneously shipped as a non-defective product.

In the embodiment, each side surface 3*b* of the lower flange portion 3 is formed in a shape in which a plurality of surfaces are connected in series (i.e., continuously in series), and the recess portion 3*e* is formed in the side surface 3*b* by these surfaces. Therefore, since the conductive wire 4 passes through the recess portions 3*e*, the positions through which the conductive wire 4 passes in the side surface 3*b* of the lower flange portion 3 are stable.

The inductance element 100 having such a structure, according to the first exemplary embodiment, can be produced, for example, by the following method.

First, the drum-shaped core 1 which includes the upper flange portion 2 and the lower flange portion 3 on both ends of the winding-core portion is produced. Specifically, powder of ferrite, alumina, or the like is loaded into a mold having a predetermined shape, and the mold is pressurized to obtain a compact. Subsequently, the compact is fired at a predetermined profile to obtain the core 1.

Next, the pair of terminal electrodes 5 is formed on the core 1. Specifically, a silver paste or a copper paste is printed in a desired shape on the bottom surface 3*a* and the end surfaces 3*c* of the lower flange portion 3 of the core 1.

Next, the conductive wire 4 is wound around the winding-core portion of the core 1. Specifically, one end portion 4*a* of the conductive wire 4 is fixed to a clamp mechanism, and then the conductive wire 4 is wound by using a wire-supply nozzle or the like.

Next, both end portions 4*a* of the conductive wire 4 are immersed in an insulating coating remover to remove the insulating coating therefrom.

Finally, both end portions 4*a* of the conductive wire 4 are compressed by a compressing jig and connected to the terminal electrodes 5 to complete the inductance element 100. When both end portions 4*a* of the conductive wire 4 are connected to the terminal electrodes 5, both end portions 4*a* may be heated or ultrasonic vibrations may be provided thereto, in addition to compression.

Next, a mounted state of the inductance element 100 according to the first exemplary embodiment will be described.

Figure 2A:
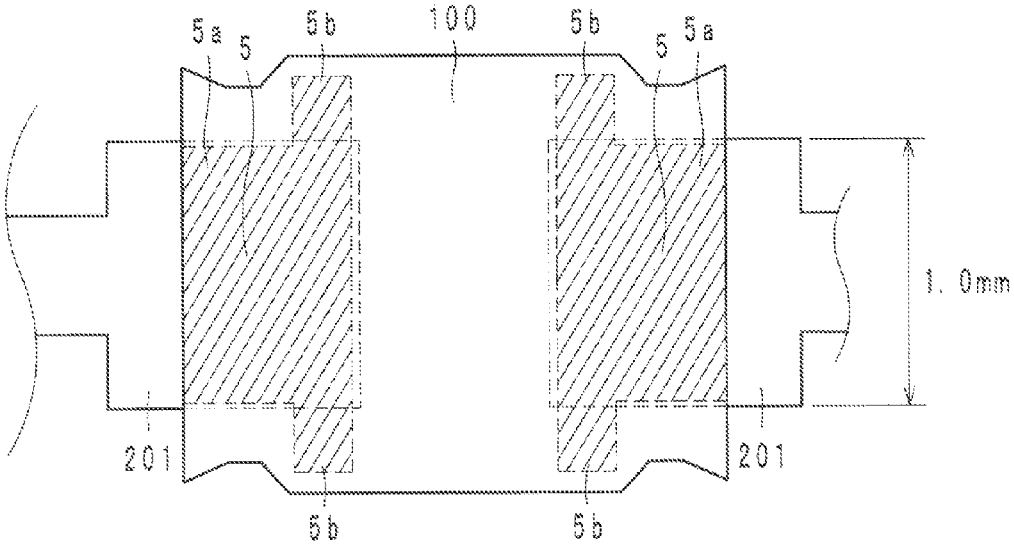
FIG. 2A is a plan view showing a state where the inductance element of FIGS. 1A and 1B is mounted on narrow land electrodes.

Since the principal electrode region 5*a* of each terminal electrode 5 is formed so as to have a width of about 1.0 mm, the inductance element 100 can appropriately be mounted on the narrow land electrodes 201 each having a width of about 1.0 mm in a width direction, as shown in FIG. 2A. In FIG. 2A, a portion of each narrow land electrode 201, which is hidden by the inductance element 100, is shown by a dotted line, each terminal electrode 5, which cannot be seen since the terminal electrode 5 is formed on the bottom surface of the inductance element 100, is shown by a dotted line with hatching, and the same applies to FIG. 2B.

Figure 2B:
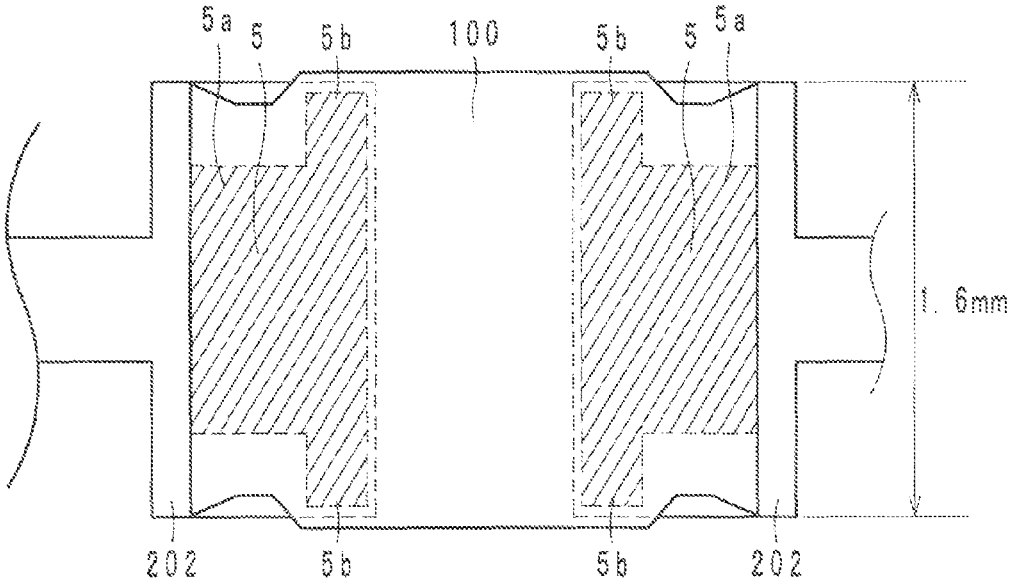
FIG. 2B is a plan view showing a state where the inductance element of FIGS. 1A and 1B is mounted on wide land electrodes.

In addition, since each terminal electrode 5 has a width of about 1.6 mm from an end of one extension electrode region 5*b* to an end of the other extension electrode region 5*b*, the inductance element 100 can appropriately be mounted also on the wide land electrodes 202 each having a width of 1.6 mm in the width direction, as shown in FIG. 2B.

As described above, the inductance element 100 according to the first exemplary embodiment can favorably be mounted on any of the narrow land electrodes 201 and the wide land electrodes 202 having different widths.

The structure, an example of the manufacturing method, and the mounted state of the inductance element 100 according to the first exemplary embodiment been described. However, the present disclosure is not limited to the above content, and various modifications can be made according to the gist of the disclosure.

For example, in the inductance element 100, the width of each principal electrode region 5*a* is about 1.0 mm, and the width from the end of one extension electrode region 5*b* to the end of the other extension electrode region 5*b* is about 1.6 mm, but the width dimensions are not limited to these widths and can be changed as appropriate according to mounted land electrodes.

Figure 3:
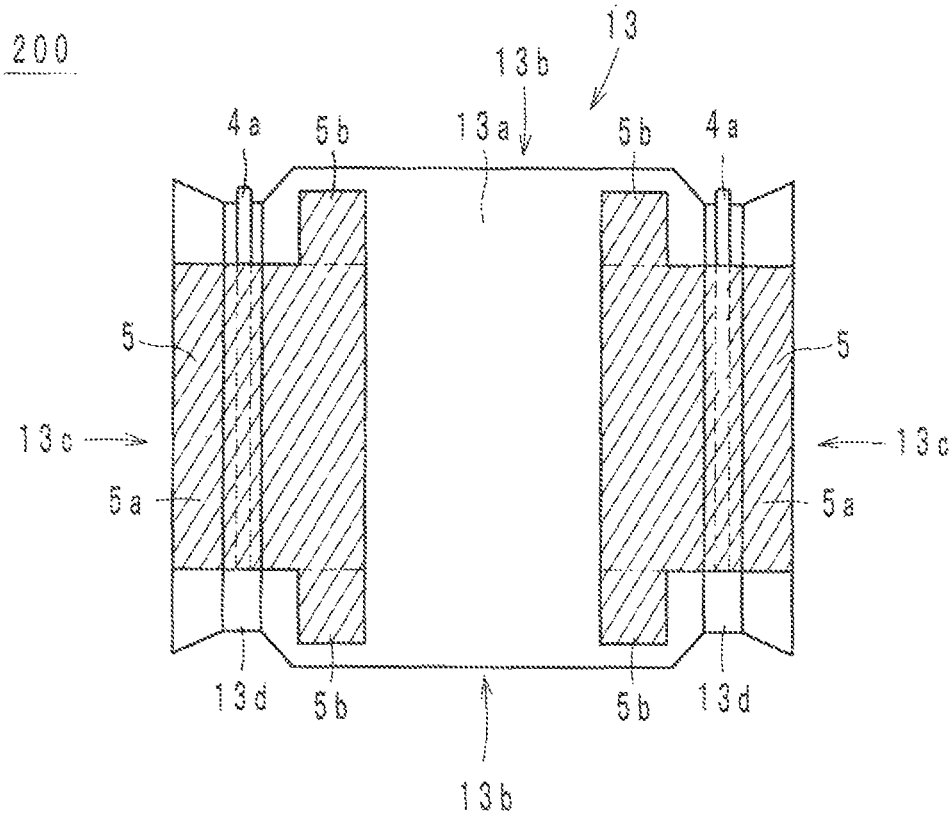
FIG. 3 is a bottom view showing an inductance element according to a second exemplary embodiment.

FIG. 3 shows an inductance element 200 according to a second exemplary embodiment.

In the inductance element 200, a pair of grooves 13*d* for accommodating both end portions 4*a* of the conductive wire 4 is provided in the bottom surface 13*a* of the lower flange portion 13. The other configuration of the inductance element 200 is the same as that of the inductance element 100 according to the first exemplary embodiment, which is shown in FIGS. 1A and 1B.

In the inductance element 200, since the grooves 13*d* for accommodating both end portions 4*a* of the conductive wire 4 are formed in the bottom surface 13*a* of the lower flange portion 13, both end portions 4*a* of the conductive wire 4 do not project from the bottom surface 13*a* of the lower flange portion 13. Therefore, the inductance element 200 is decreased in height than the inductance element 100.

Figure 4:
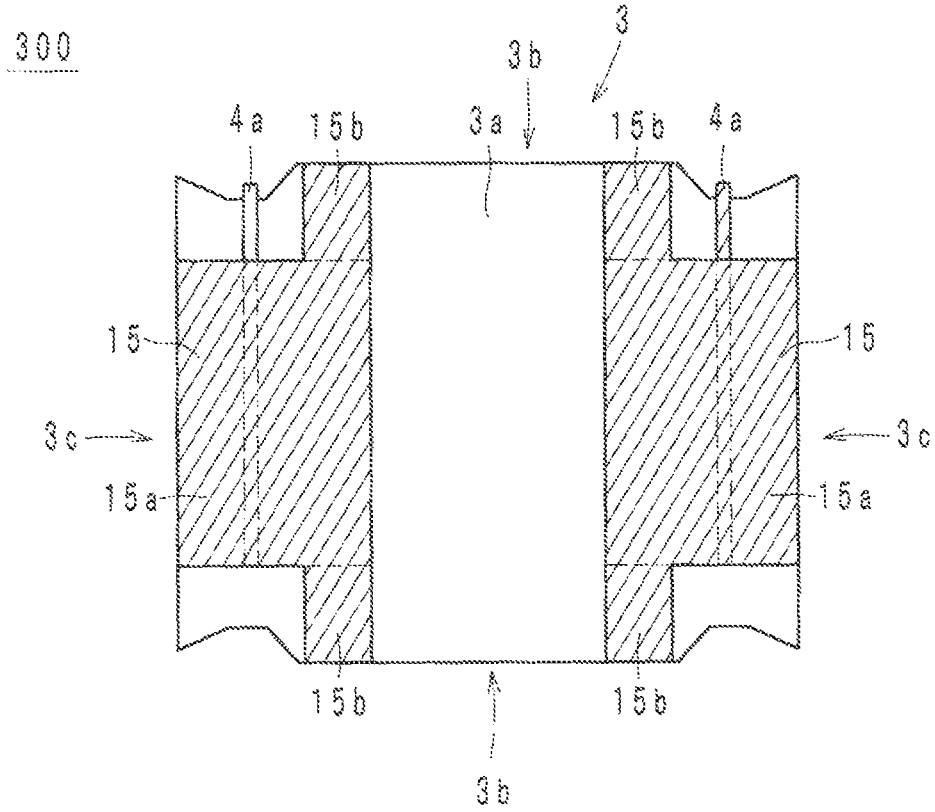
FIG. 4 is a bottom view showing an inductance element according to a third exemplary embodiment.

FIG. 4 shows an inductance element 300 according to a third exemplary embodiment.

In the inductance element 300, extension electrode regions 15*b* of each terminal electrode 15 are formed so as to extend from a principal electrode region 15*a* to the sides formed by the bottom surface 3*a* and the side surfaces 3*b* of the lower flange portion 3. The other configuration of the inductance element 300 is the same as that of the inductance element 100 according to the first exemplary embodiment, which is shown in FIGS. 1A and 1B.

In the inductance element 300, the width of the lower flange portion 3 can be adjusted to a width from an end of one extension electrode region 15*b* to an end of the other extension electrode region 15*b*, which width is determined and adjusted to a mounted land electrode. In other words, the width of the lower flange portion 3 can be decreased to a required minimum and the inductance element 300 can be decreased in size.

Figure 5:
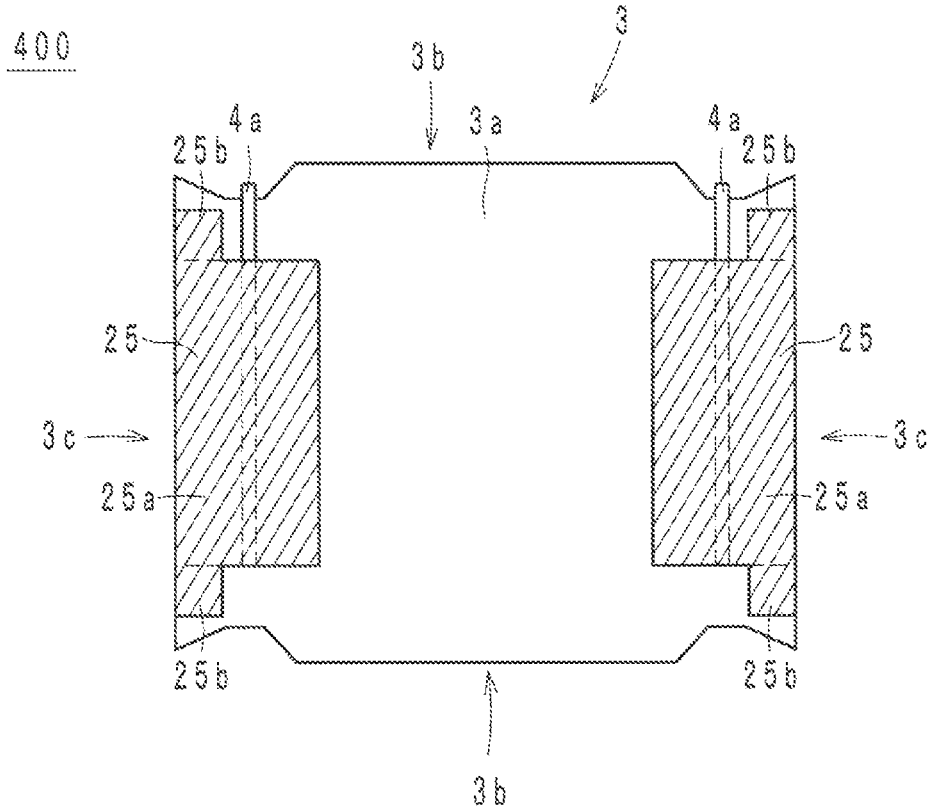
FIG. 5 is a bottom view showing an inductance element according to a fourth exemplary embodiment.

FIG. 5 shows an inductance element 400 according to a fourth exemplary embodiment.

In the inductance element 400, a pair of extension electrode regions 25*b* is formed so as to extend from a principal electrode region 25*a* of each terminal electrode 25 toward the side surfaces 3*b* of the lower flange portion 3 along the end surface 3*c* of the lower flange portion 3. The other configuration of the inductance element 400 is the same as that of the inductance element 100 according to the first exemplary embodiment, which is shown in FIGS. 1A and 1B.

As described above, the extension electrode regions 25*b* of each terminal electrode 25 can be formed in arbitrary positions. The inductance element 400 can also favorably be mounted on any of two types of land electrodes having different widths.

Figure 6:
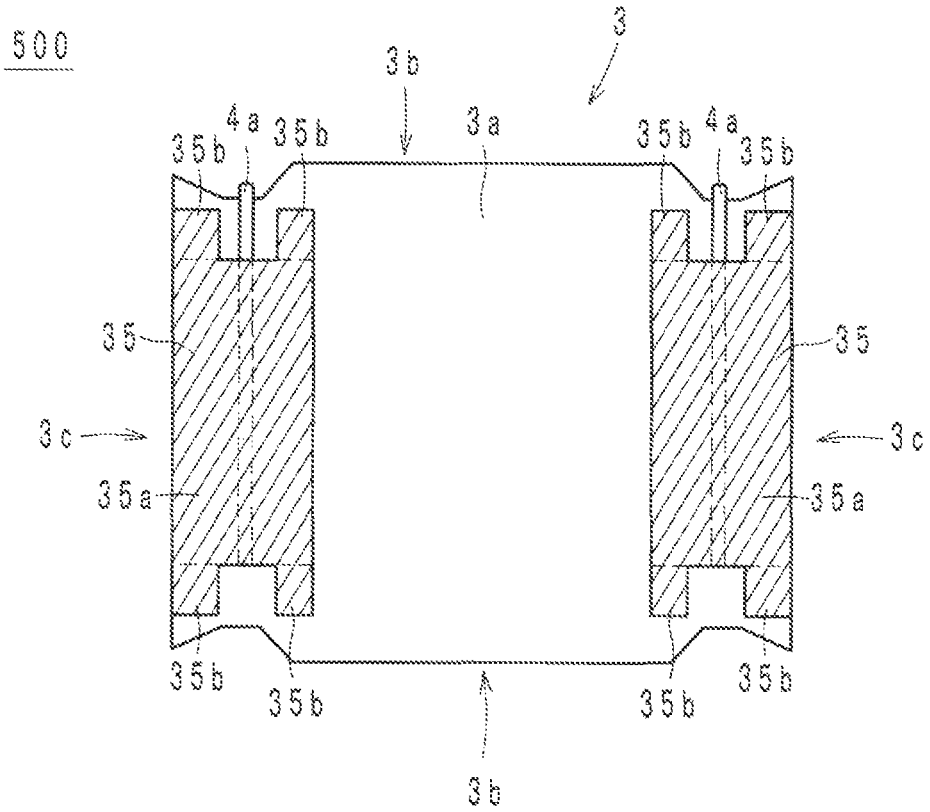
FIG. 6 is a bottom view showing an inductance element according to a fifth exemplary embodiment.

FIG. 6 shows an inductance element 500 according to a fifth exemplary embodiment.

In the inductance element 500, two pairs of extension electrode regions 35*b* are formed so as to extend from a principal electrode region 35*a* of each terminal electrode 35 toward the respective side surfaces 3*b* of the lower flange portion 3. In other words, the extension electrode regions 35*b* are formed on both sides of the connection portion between each end portion 4*a* of the conductive wire 4 and the terminal electrode 35. The other configuration of the inductance element 500 is the same as that of the inductance element 100 according to the first exemplary embodiment, which is shown in FIGS. 1A and 1B.

As described above, the number of pairs of extension electrode regions 35*b* provided in each terminal electrode 35 is arbitrary, and the inductance element 500 can also favorably be mounted on any of two types of land electrodes having different widths.

Figure 7:
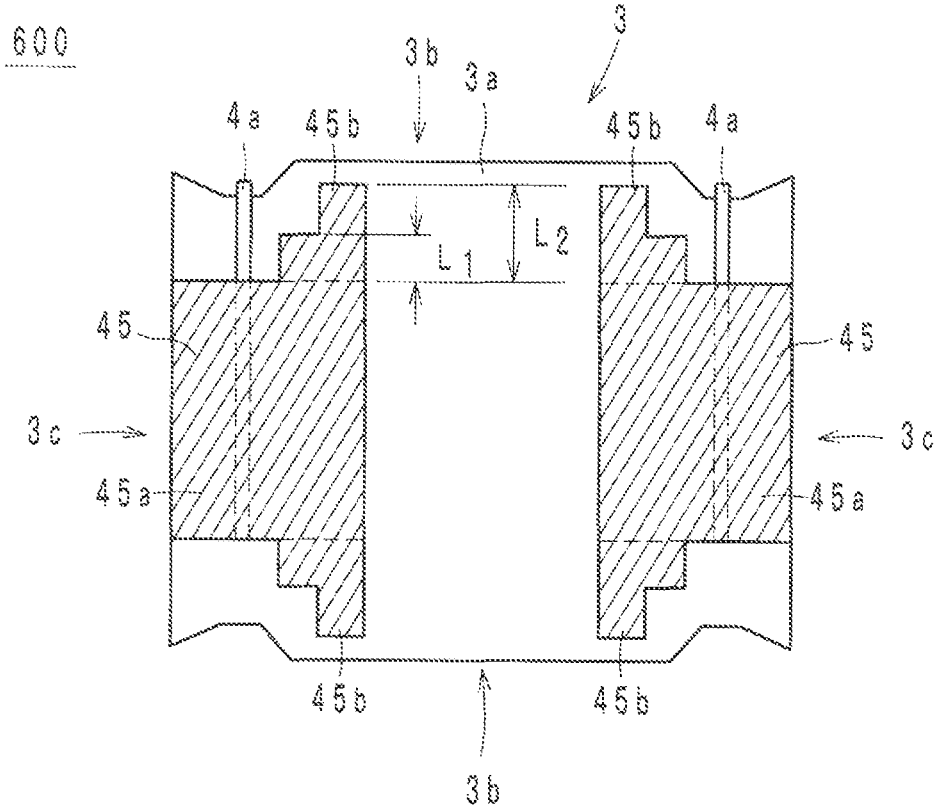
FIG. 7 is a bottom view showing an inductance element according to a sixth exemplary embodiment.

FIG. 7 shows an inductance element 600 according to a sixth exemplary embodiment.

In the inductance element 600, a pair of extension electrode regions 45*b* is formed so that each extension electrode region 45*b* extends from a principal electrode region 45*a* of each terminal electrode 45 toward the side surfaces 3*b* of the lower flange portion 3, each has a step-like portion formed therein, and each has two different lengths in the width direction. In other words, as shown in FIG. 7, each extension electrode region 45*b* has two different lengths L1 and L2 from the principal electrode region 45*a* toward the side surface 3*b* of the lower flange portion 3. The other configuration of the inductance element 600 is the same as that of the inductance element 100 according to the first exemplary embodiment, which is shown in FIGS. 1A and 1B.

As described above, when the step-like portion is formed in each extension electrode region 45*b* such that each extension electrode region 45*b* has two different lengths, the principal electrode region and each extension region allow mounting on any of land electrodes having three different widths.

Figure 8:
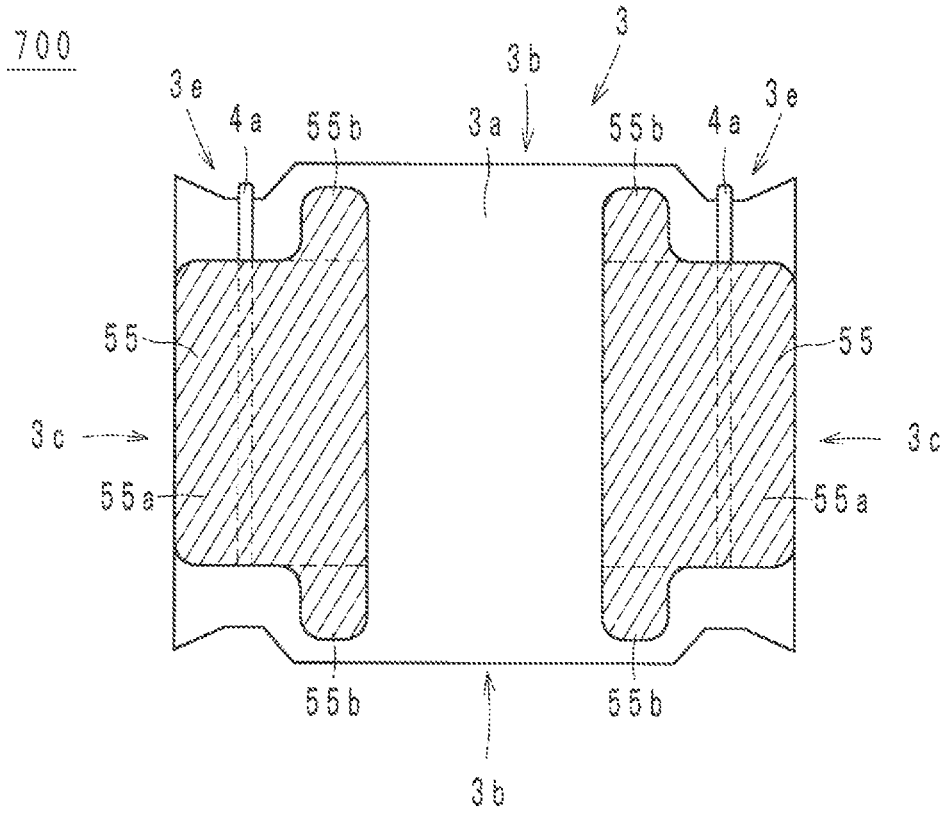
FIG. 8 is a bottom view showing an inductance element according to a seventh exemplary embodiment.
Figure 9:
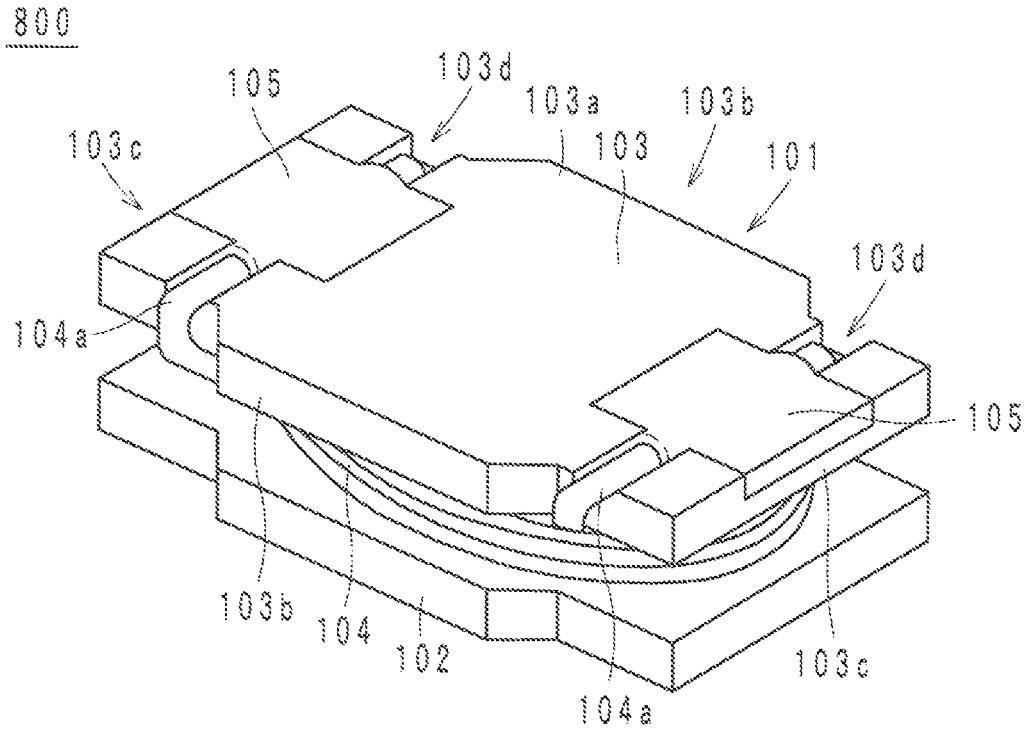
FIG. 9 Prior Art
FIG. 9 is a perspective view showing an existing inductance element.

FIG. 8 shows an inductance element 700 according to a seventh exemplary embodiment.

In the inductance element 700, the corners of each terminal electrode 55 are substantially rounded. In other words, the corners of each principal electrode region 55*a* and each extension electrode region 55*b* are substantially rounded. The other configuration of the inductance element 700 is the same as that of the inductance element 100 according to the first exemplary embodiment, which is shown in FIGS. 1A and 1B.

As described above, the corners of the terminal electrodes do not have to be at right angles, and may be substantially rounded as in the terminal electrodes 55 of the embodiment.

According to embodiments of the present disclosure, since the principal electrode region and at least the pair of extension electrode regions extending from the principal electrode region toward the respective side surfaces of the lower flange portion are provided, the inductance element can be mounted on any of land electrodes having a plurality of different widths.

In addition, according to embodiments of the present disclosure, since the extension electrode regions of each terminal electrode are not formed on the region of the bottom surface of the lower flange portion through which both end portions of the conductive wire pass, when the conductive wire is broken near the region, the breakage can easily be found.

In an embodiment in which a recess portion through which the conductive wire passes is formed in the side surface of the lower flange portion, during manufacturing, mounting, or the like, even when an object (an apparatus, a jig, another electronic component, etc.) unexpectedly collides with the side surface of the lower flange portion, the conductive wire is not broken easily.

In an embodiment in which the terminal electrodes each further include an end surface electrode region formed on the corresponding end surface of the lower flange portion, after mounting, a solder fillet can be formed between the end surface electrode region and the land electrode, and thus strong joining can be realized.

In an embodiment in which each extension electrode region of each terminal electrode includes a step-like portion formed therein and has a plurality of different lengths from the principal electrode region toward the corresponding side surface of the lower flange portion, for example, when each extension electrode region has two different lengths, the inductance element allows mounting on any of land electrodes having three different widths using the principal electrode region and each extension electrode region.

While exemplary embodiments have been described above, it is to be understood that variations and modifications will be apparent to those skilled in the art without departing from the scope and spirit of the disclosure.

What is claimed is:

1. An inductance element comprising:

a core including a winding-core portion and an upper flange portion and a lower flange portion which are formed on both ends of the winding-core portion;

a conductive wire wound around the winding-core portion; and a pair of terminal electrodes formed on the lower flange portion, wherein the lower flange portion has an inner surface, a bottom surface, a pair of side surfaces, and a pair of end surfaces, the pair of terminal electrodes each include a principal electrode region formed on the bottom surface of the lower flange portion and at least a pair of extension electrode regions, each extension electrode region of the pair extending from the principal electrode region toward a respective one of the side surfaces of the lower flange portion, end portions of the conductive wire are each connected to one of the terminal electrodes through one of the side surfaces and the bottom surface of the lower flange portion, and the extension electrode regions of each terminal electrode are not formed on a region of the bottom surface of the lower flange portion through which one of the end portions of the conductive wire pass such that the bottom surface of the flange is exposed in a region between each extension electrode region and the respective end portion of conductive wires that passes the bottom surface before connecting to the respective terminal electrode, each of the terminal electrodes is not formed between the corresponding conductive wire and the bottom surface of the lower flange portion, in each of the pair of terminal electrodes, a distance between an end of one of the pair of extension electrode regions and an end of another of the pair of extension electrode regions in a direction along to the pair of extension electrode regions is different from a distance between both ends of the principal electrode region in the direction along to the pair of extension electrode regions, and the distance between an end of the pair of extension electrode regions and an end of another of the pair of extension electrode regions, and the distance between both ends of the principal electrode region are determined on the basis of a plurality of land electrodes to which each of the pair of terminal electrodes is to be mounted, the plurality of land electrodes having different distances in the direction along to the pair of extension electrode regions.

2. The inductance element according to claim 1, wherein a recess portion through which the conductive wire passes is formed in the side surface of the lower flange portion.

3. The inductance element according to claim 1, wherein the terminal electrodes each further include an end surface electrode region formed on the corresponding end surface of the lower flange portion.

4. The inductance element according to claim 1, wherein each extension electrode region of each terminal electrode has a step-like portion formed therein and has a plurality of different lengths from the principal electrode region toward the corresponding side surface of the lower flange portion.

5. The inductance element according to claim 1, wherein each extension electrode region of each terminal electrode extends to the respective one of the side surfaces of the lower flange portion.

6. The inductance element according to claim 1, wherein the bottom surface of the lower flange portion includes a groove positioned under each terminal electrode, and the end portions of the conductive wire are positioned in respective ones of the grooves.

7. The inductance element according to claim 1, wherein each extension electrode region of each terminal electrode extends along the bottom surface adjacent to one of the end surfaces of the lower flange portion.

* * * * *